US010096902B2

(12) United States Patent
Raggam et al.

(10) Patent No.: US 10,096,902 B2
(45) Date of Patent: Oct. 9, 2018

(54) ANTENNA ARRANGEMENT, COMMUNICATION APPLIANCE AND ANTENNA STRUCTURE

(71) Applicant: Infineon Technologies AG, Neubiberg (DE)

(72) Inventors: Peter Raggam, St. Stefan i. R. (AT); Oliver Kronschlaeger, Graz (AT); Stephan Rampetzreiter, Graz (AT); Josef Gruber, St. Ruprecht an der Raab (AT)

(73) Assignee: Infineon Technologies AG, Neubiberg (DE)

( * ) Notice: Subject to any disclaimer, the term of this patent is extended or adjusted under 35 U.S.C. 154(b) by 207 days.

(21) Appl. No.: 14/258,032

(22) Filed: Apr. 22, 2014

(65) Prior Publication Data

US 2014/0313092 A1 Oct. 23, 2014

(30) Foreign Application Priority Data

Apr. 22, 2013 (DE) ..... 10 2013 104 059

(51) Int. Cl.
*H01Q 7/08* (2006.01)
*H01Q 1/22* (2006.01)

(52) U.S. Cl.
CPC ..... *H01Q 7/08* (2013.01); *H01Q 1/2216* (2013.01)

(58) Field of Classification Search
CPC ..... H01Q 7/08; H01Q 7/06; H01Q 1/2216
USPC ..... 235/491; 343/787; 742/867
See application file for complete search history.

(56) References Cited

U.S. PATENT DOCUMENTS 2,399,382 A * 4/1946 Polydoroff ..... H01Q 7/06 336/188
6,163,305 A 12/2000 Murakami et al.
6,664,936 B2 12/2003 Ieda et al.
6,924,767 B2 8/2005 Kitahara et al.
6,965,296 B2 11/2005 Kamlah
8,698,685 B2 4/2014 Ito et al.
(Continued)

FOREIGN PATENT DOCUMENTS

CN 102132457 A 7/2011
CN 102959800 A 3/2013
(Continued)

OTHER PUBLICATIONS

Office Action issued in the corresponding German application No. 102013104059.4, dated Oct. 8, 2013, 6 pages.

*Primary Examiner* — Graham Smith
*Assistant Examiner* — Noel Maldonado
(74) *Attorney, Agent, or Firm* — Viering, Jentschura & Partner mbB

(57) ABSTRACT

In various embodiments, an antenna arrangement is provided. The antenna arrangement may include at least one integrated circuit; at least one loop antenna that is coupled to the integrated circuit and that forms a loop antenna region; at least one antenna that is coupled to the integrated circuit and that has a magnet core; wherein at least one portion of the magnet core is arranged above a portion of the loop antenna region; wherein the portion of the magnet core overlaps the portion of the loop antenna region; or wherein the portion of the magnet core does not overlap the portion of the loop antenna region.

20 Claims, 13 Drawing Sheets

(56) References Cited

U.S. PATENT DOCUMENTS

| | | | | |
|---|---|---|---|---|
| 8,849,195 | B2 * | 9/2014 | Orihara | H01Q 1/243 343/787 |
| 2007/0126650 | A1 * | 6/2007 | Guenther | H01Q 7/06 343/788 |
| 2012/0071090 | A1 * | 3/2012 | Charrat | G06K 19/07771 455/41.1 |
| 2012/0081257 | A1 | 4/2012 | Yosui et al. | |
| 2012/0081258 | A1 | 4/2012 | Yosui et al. | |
| 2013/0181876 | A1 * | 7/2013 | Miura | G06K 7/10316 343/788 |

FOREIGN PATENT DOCUMENTS

| | | | |
|---|---|---|---|
| DE | 4105826 | A1 | 9/1991 |
| DE | 69707024 | T2 | 7/1997 |
| DE | 19812836 | A1 | 9/1999 |
| DE | 19924022 | A1 | 12/1999 |
| DE | 10107319 | A1 | 1/2002 |
| DE | 10045776 | A1 | 4/2002 |
| DE | 10324847 | A1 | 12/2003 |
| DE | 102007019272 | A1 | 10/2007 |
| DE | 102010024439 | A1 | 1/2011 |
| DE | 102010005809 | A1 | 7/2011 |
| DE | 102011012228 | A1 | 8/2012 |
| DE | 102011012230 | A1 | 8/2012 |
| EP | 0783190 | A1 | 7/1997 |
| EP | 1317016 | A1 | 6/2003 |
| EP | 2293383 | A2 | 3/2011 |
| EP | 2418729 | A2 | 2/2012 |
| EP | 2600362 | A2 | 6/2013 |
| GB | 2243955 | A | 11/1991 |
| GB | 2470113 | A | 11/2010 |
| GB | 2470299 | A | 11/2010 |
| GB | 2505577 | A | 3/2014 |
| JP | 2009206974 | A | 9/2009 |
| JP | 2013009071 | A | 1/2013 |
| WO | 2010023574 | A2 | 3/2010 |
| WO | 2012033031 | A1 | 3/2012 |
| WO | 2012173080 | A1 | 12/2012 |

* cited by examiner

ANTENNA ARRANGEMENT, COMMUNICATION APPLIANCE AND ANTENNA STRUCTURE

CROSS-REFERENCE TO RELATED APPLICATION

This application claims priority to German Patent Application Serial No. 10 2013 104 059.4, which was filed Apr. 22, 2013, and is incorporated herein by reference in its entirety.

TECHNICAL FIELD

Various embodiments relate generally to an antenna arrangement, a communication appliance and an antenna structure.

BACKGROUND

FIG. 1A and FIG. 1B show a conventional antenna arrangement 100 in the form of a subscriber identity module (SIM), with FIG. 1A showing the antenna arrangement 100 in a plan view and FIG. 1B showing the antenna arrangement 100 in a cross-sectional view.

The antenna arrangement 100 has a common support 116, with a front 110 of the support 116 holding a loop antenna 102 having a plurality of turns 104. In addition, a back 112 of the support 116 holds a contact array 106 having a plurality of contact pads 108. As FIG. 1B shows, an electric current flowing through the turns 104 of the loop antenna 102 results in a magnetic field being produced, the magnetic field lines 114 shown in FIG. 1B being intended to be understood merely by way of outline. However, it is possible to see that the magnetic field lines 114 are produced at an angle (essentially at right angles) to the plane that is formed by the loop antenna 102, and hence at an angle to the plane of the front 110 of the support 116. Accordingly, even just an externally produced magnetic field induces a sufficiently large electric current in the loop antenna 102 when the magnetic field lines of the externally produced magnetic field pass through a region within the turns 104 of the loop antenna 102 (subsequently also called the loop region) at an angle (essentially at right angles, then the maximal electric current is induced) to the plane that is formed by the loop antenna 102.

Within the context of near-field communication with a reader 200, this structure of the loop antenna 102 has a good level of performance when the antenna plane of an antenna 202 of the reader 200, which antenna provides the externally produced magnetic field 204 for the loop antenna 102, for example, is essentially parallel to the plane of the loop antenna 102 (see FIG. 2). The efficiency of the loop antenna 102 is adversely influenced to a considerable degree, however, when the loop antenna 102 is covered even just to some extent by metal, which in this case brings about a kind of shielding of the magnetic field.

FIG. 3 shows an arrangement 300 with a battery 302 and the antenna arrangement 100 from FIG. 1A and FIG. 1B, which is arranged on a printed circuit board 304 (that is produced to some extent from metal, for example), wherein the contact pads 108 of the contact array 106 are electrically conductively coupled to electrical contacts (not shown) of the printed circuit board 304 by means of electrically conductive connections 306 (for example by means of solder joints 306). As FIG. 3 shows, magnetic field lines 308 that are possibly produced are blocked by the metal-containing battery 302 and the metal of the printed circuit board 304, both of which act as a magnetic shield, which means that near-field communication between the reader 200 and the antenna arrangement 100 is no longer possible, for example.

FIG. 4 shows a conventional antenna 400 with a ferrite core 402 in a plan view. The ferrite core 402 of the antenna 400 has an elongate parallelepipedal structure and hence four longitudinal lateral faces 408 and two end faces 410. In addition, the antenna 400 has a plurality of turns 404 that are arranged, for example are wound, around the four longitudinal lateral faces 408 of the ferrite core 402. In addition, magnetic field lines 406 are schematically shown that to some extent run through the end faces 410 and inside the ferrite core 402 in the longitudinal direction thereof and outside the ferrite core 402 essentially elliptically.

FIG. 5 shows a conventional antenna arrangement 500 in the form of a subscriber identity module (SIM) in a plan view.

The antenna arrangement 500 has a common support 502, with a front of the support 502 holding an antenna 400, as shown in FIG. 4. In addition, a back of the support 502 holds a contact array 504 having a plurality of contact pads 506. The magnetic field formed by the antenna 400, or the magnetic field lines 406 of said magnetic field, run(s) essentially parallel to the plane of the front of the support 502, and said magnetic field essentially has no magnetic field lines that run at an angle to the plane of the front of the support 502. Hence, the magnetic field is formed essentially only in one direction, namely along the longitudinal lateral faces 408 of the ferrite core 402. In the case of the antenna arrangement 500 shown in FIG. 5, the ferrite core 402 has its longitudinal extent arranged parallel to the longitudinal extent of the support 502.

FIG. 6 shows another conventional antenna arrangement 600 in a plan view. The antenna arrangement 600 is essentially the same as the antenna arrangement 500 from FIG. 5 with the difference that in the case of the antenna arrangement 600 shown in FIG. 6 the ferrite core 402 has its longitudinal extent arranged at right angles to the longitudinal extent of the support 502.

FIG. 7 shows an arrangement 700 with a battery 702 and the antenna arrangement 400 from FIG. 4, which is arranged on a printed circuit board 704 (that is produced to some extent from metal, for example), wherein the contact pads 506 of the contact array 504 are electrically conductively coupled to electrical contacts (not shown) of the printed circuit board 704 by means of electrically conductive connections 706 (for example by means of solder joints 706). As FIG. 7 shows, magnetic field lines 406 that are possibly produced are also hardly blocked by the metal-containing battery 702 and the metal of the printed circuit board 704, both of which act as a magnetic shield, however, which means that in this case near-field communication (albeit relatively poor, but already improved in comparison with the arrangement shown in FIG. 3) between the reader 700 and the antenna arrangement 400 is possible.

SUMMARY

In various embodiments, an antenna arrangement is provided. The antenna arrangement may include at least one integrated circuit; at least one loop antenna that is coupled to the integrated circuit and that forms a loop antenna region; at least one antenna that is coupled to the integrated circuit and that has a magnet core; wherein at least one portion of the magnet core is arranged above a portion of the loop antenna region; wherein the portion of the magnet core overlaps the portion of the loop antenna region; or wherein the portion of the magnet core does not overlap the portion of the loop antenna region.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

The following detailed description refers to the accompanying drawings that show, by way of illustration, specific details and embodiments in which the invention may be practiced.

In the detailed description that follows, reference is made to the appended drawings, which form part of this description and which show specific embodiments in which the invention can be executed for the purpose of illustration. In this respect, directional terminology such as "at the top", "at the bottom", "at the front", "at the rear", "front", "rear", etc., is used with reference to the orientation of the figure(s) described. Since components of embodiments can be positioned in a number of different orientations, the directional terminology is used for the purpose of illustration and is in no way restrictive. It goes without saying that other embodiments can be used and structural or logical changes made without departing from the scope of protection of the present invention. It goes without saying that the features of the various embodiments described herein can be combined with one another unless specifically stated otherwise. The following detailed description should therefore not be regarded as restrictive, and the scope of protection of the present invention is defined by the attached claims.

Within the context of this description, the terms "connected" and "coupled" are used to describe both direct and indirect connection, and also direct and indirect coupling. In the figures, identical or similar elements are provided with identical reference symbols, insofar as this is expedient.

In various embodiments, an antenna arrangement is provided that both has a good level of performance and works sufficiently well when a metal shield is arranged above or below an antenna structure of the antenna arrangement.

As a good example, various embodiments provide an antenna structure in an antenna arrangement that is formed firstly by a loop antenna, with the turns of the loop antenna defining a loop region through which essentially the magnetic field of the loop antenna flows, and secondly by an antenna having a magnet core, wherein at least one portion of the magnet core covers a portion of the loop antenna region (region of turns of the loop antenna and loop region). As a result, the antenna structure is used to provide a magnetic field in all three spatial directions, i.e. both essentially at right angles to the plane defined by the loop antenna region and essentially parallel to the plane defined by the loop antenna region, or the antenna structure can receive such a magnetic field from all three spatial directions and can pick it up and process it with sufficient sensitivity.

Figure 1A:
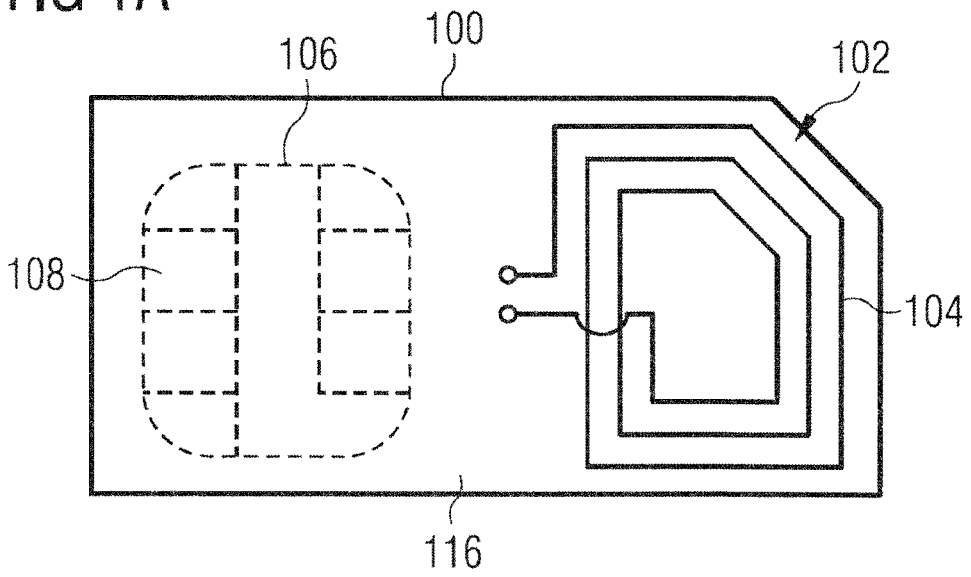
FIGS. 1A and 1B show a conventional antenna arrangement in plan view (FIG. 1A) and in cross-sectional view (FIG. 1B)
Figure 1B:
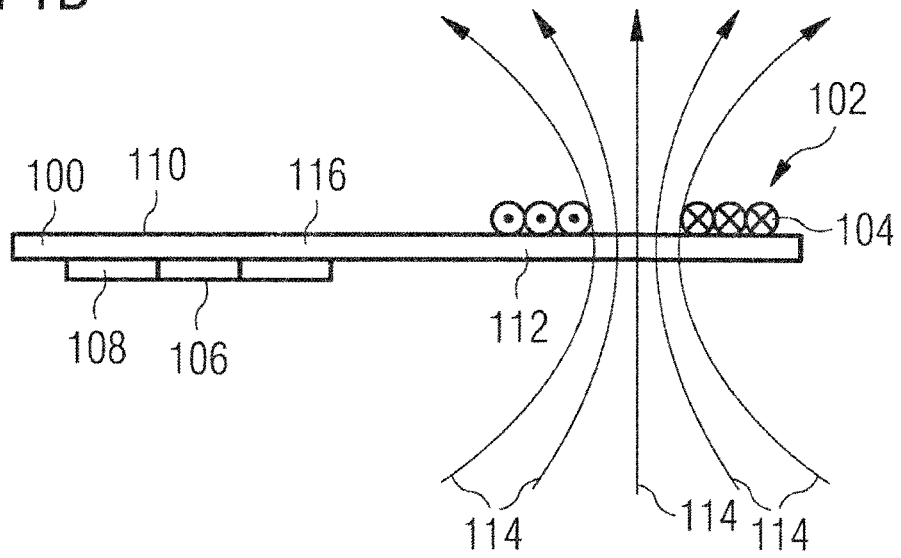
Figure 2:
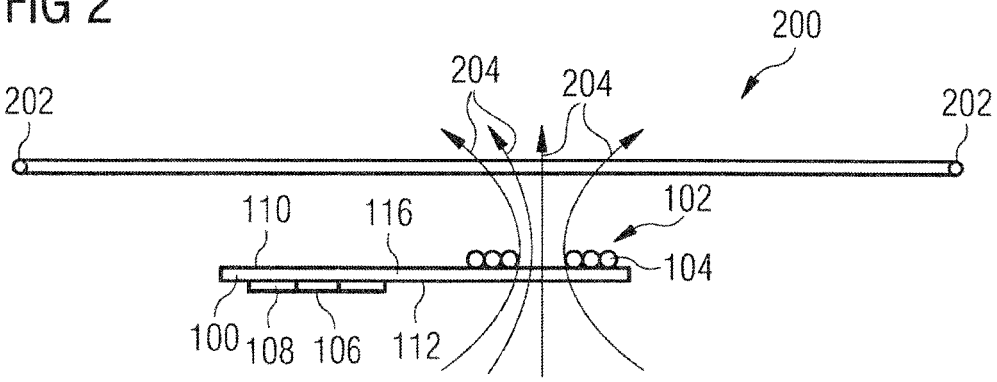
FIG. 2 shows an arrangement with a reader and a conventional antenna arrangement from FIG. 1A and FIG. 1B.
Figure 3:
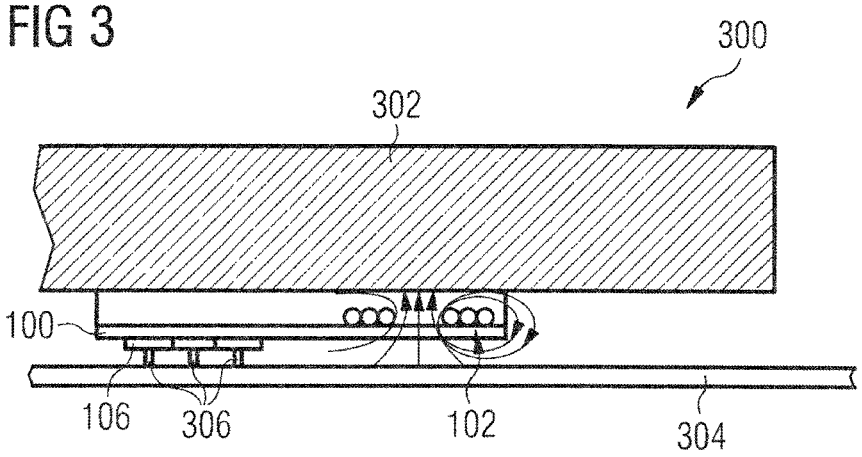
FIG. 3 shows an arrangement with a battery and a conventional antenna arrangement from FIG. 1A and FIG. 1B that is arranged on a printed circuit board.
Figure 4:
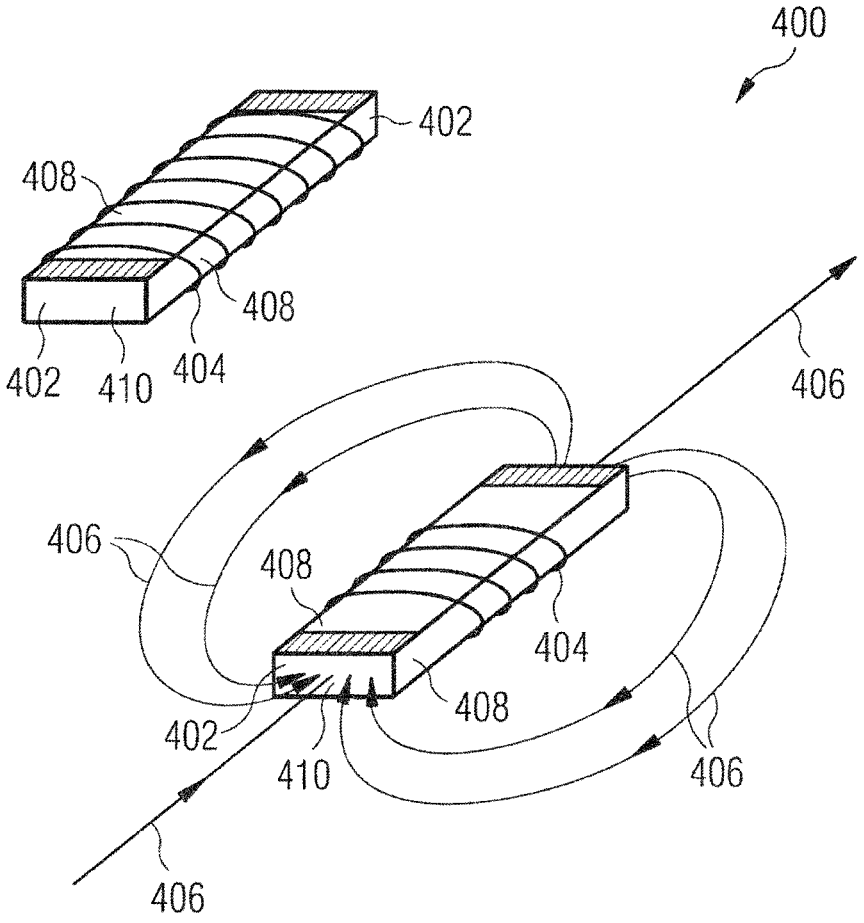
FIG. 4 shows a conventional antenna with a ferrite core in plan view.
Figure 5:
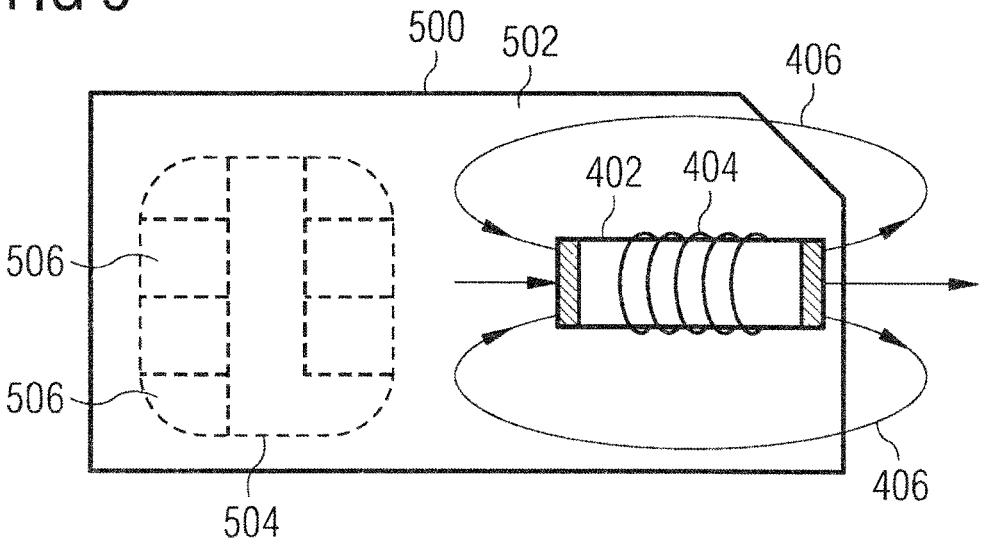
FIG. 5 shows a conventional antenna arrangement in plan view.
Figure 6:
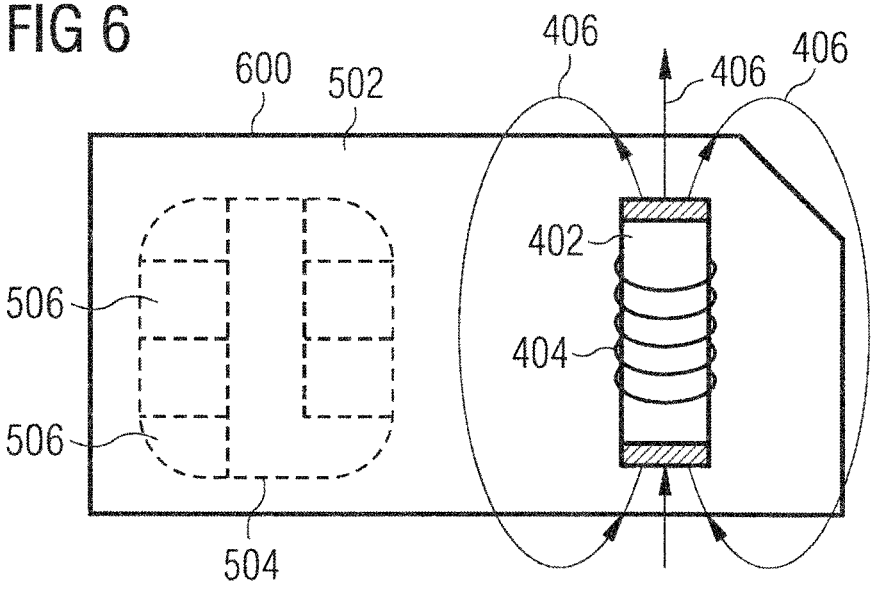
FIG. 6 shows another conventional antenna arrangement in plan view.
Figure 7:
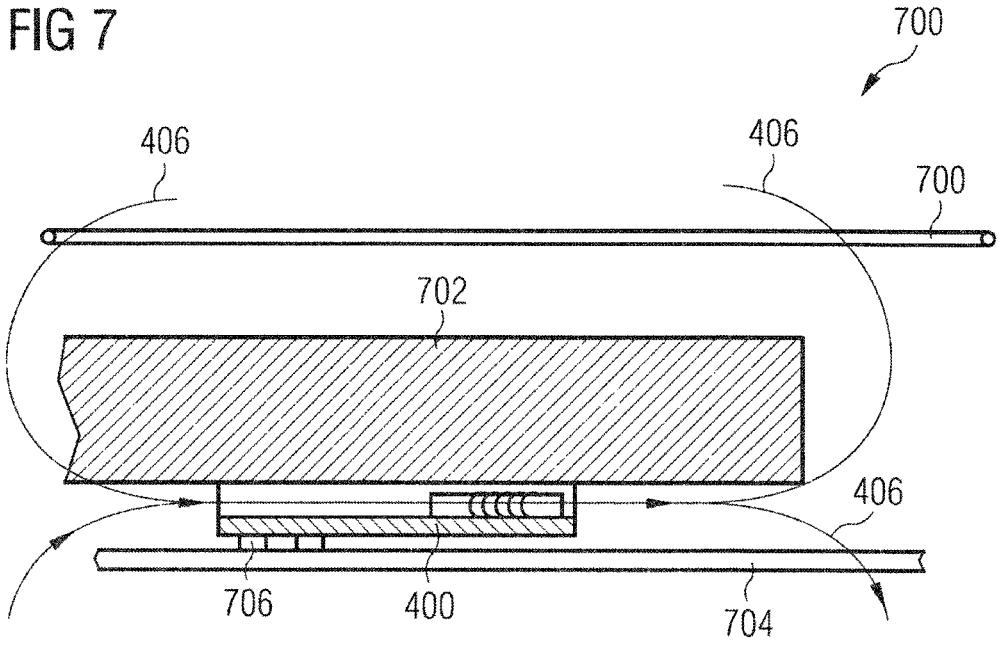
FIG. 7 shows an arrangement with a reader and a conventional antenna arrangement from FIG. 5.
Figure 8A:
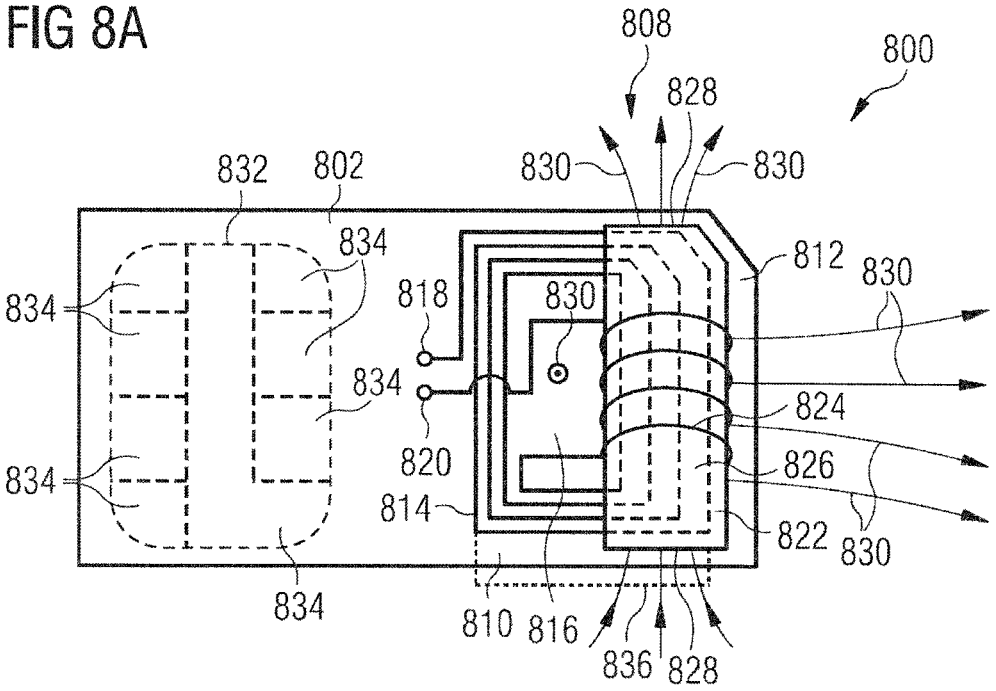
FIGS. 8A and 8B show a portion of an antenna arrangement in plan view (FIG. 8A) and in cross-sectional view (FIG. 8B) according to various embodiments.
Figure 8B:
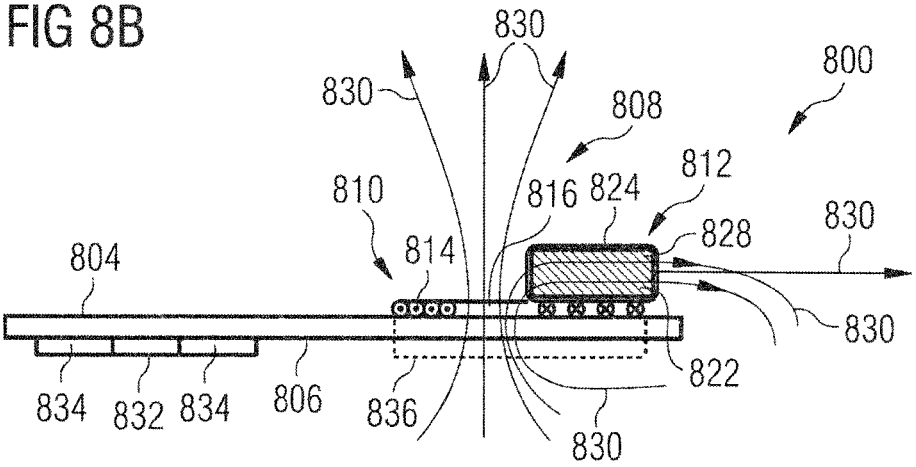

FIG. 8A and FIG. 8B show a portion 800 of an antenna arrangement in plan view (FIG. 8A) and in cross-sectional view (FIG. 8B) according to various embodiments.

In various embodiments, the antenna arrangement may be set up as a subscriber identity module (SIM) or as a UMTS subscriber identity module (USIM). However, it should be pointed out that the embodiments are not limited to such an antenna arrangement, but rather that an arbitrary arrangement is provided in various embodiments with an integrated circuit (for example a chip) or with a plurality of integrated circuits (for example a plurality of chips) and also with an antenna structure, as has been described above and as is explained in even more detail below. Thus, the antenna arrangement may, in various embodiments, be generally part of a chip card, or may form a chip card, for example a contactless chip card, which may optionally additionally be provided with a contact array having one or more contact pads.

That portion 800 of the antenna arrangement that is shown in FIG. 8A and FIG. 8B has a support 802 that, by way of example, is formed from an electrically insulating material, for example from a plastic material. The support 802 has a first side (for example a front) 804 and a second side (for example a back) 806, which is arranged opposite the first side (for example the front) 804. The first side may hold an antenna structure 808. The antenna structure 808 may have one or more loop antennas 810 and also one or more antennas 812 having a magnet core 822.

The support 802 may have the size of a standard SIM card, that is to say 85.60 mm (length)×53.98 mm (width)× 0.76 mm (thickness), for example. The size of the support 802 may alternatively also be embodied in accordance with the format of a mini SIM card, for example, that is to say 25 mm (length)×15 mm (width)×0.76 mm (thickness), for example. In other embodiments, other sizes of the support 802 are naturally likewise envisaged and possible.

The loop antenna 810 may have one or more turns (for example 2, 3, 4, 5, 6, 7, 8, 9, 10 or more) 814 that surround a region 816 inside the loop on the support 802, and hence define a loop region 816. A first (outer) end of the turns 814 is electrically conductively connected to a first loop antenna connection 818. A second (inner) end of the turns 814 is electrically conductively connected to a second loop antenna connection 820. As a good example, the loop antenna may be in the form of a planar antenna.

The antenna 812 with magnet core 822 additionally has one or more antenna turns (for example 2, 3, 4, 5, 6, 7, 8, 9, 10 or more) 824 that are arranged around the magnet core 822, for example are wound around the magnet core 822.

In alternative embodiments, provision is made for production with a printed circuit board to involve the conductors being routed around the magnet core (for example ferrite core) by virtue of said conductors being provided in the layers of the printed circuit board above and below the magnet core (for example ferrite core) and being electrically conductively connected by means of vias, for example.

The magnet core 822 may have permanently magnetic material or be formed from such material. By way of example, the magnet core 822 may be formed from a ferrite material, even if other permanently magnetic material may be provided in other embodiments.

By way of example, the magnet core 822 may be dimensioned such that it has an elongate structure, i.e. has a length that is greater than its width. Thus, the magnet core 822 may have, by way of example, a length in a range from approximately 5 mm to approximately 10 mm, for example a length in a range from approximately 10 mm to approximately 20 mm, for example a length in a range from approximately 20 mm to approximately 1000 mm. In addition, the magnet core 822 may have, by way of example, a width in a range from approximately 3 mm to approximately 5 mm. Finally, the magnet core 822 may have, by way of example, a thickness in a range from approximately 3 mm to approximately 5 mm. On the basis of the elongate structure of the magnet core 822, said magnet core has a plurality (for example four) of longitudinal lateral faces 826 and also two end faces 828. In one embodiment, the at least one turn 824 may be arranged around the longitudinal lateral faces of the magnet core 822. Alternatively, the magnet core 822 may also be embodied in cylinder form, in which case the magnet core 822 has only one longitudinal lateral face (the generated face) 826.

In various embodiments, provision may be made for the at least one turn 824 of the antenna 812 with magnet core 822 and the at least one turn 814 of the loop antenna 810 to be electrically conductively connected to one another, for example formed by a common wire, or by a plurality of wires that are electrically conductively connected to one another.

As FIG. 8A and FIG. 8B show, a portion of the magnet core 822 covers a portion of the loop antenna region 836 and, by way of example, also a portion of the loop region 816. In various embodiments, the portion of the magnet core 822 and hence the portion of the antenna may cover no more than 75% of the area of the loop antenna region 836, for example no more than 70% of the area of the loop antenna region 836, for example no more than 65% of the area of the loop antenna region 836, for example no more than 60% of the area of the loop antenna region 836, for example no more than 55% of the area of the loop antenna region 836, for example no more than 50% of the area of the loop antenna region 836, or less, but, by way of example, at least 10% of the area of the loop antenna region 836, for example at least 15% of the area of the loop antenna region 836, for example at least 20% of the area of the loop antenna region 836, for example at least 25% of the area of the loop antenna region 836, for example at least 30% of the area of the loop antenna region 836, for example at least 35% of the area of the loop antenna region 836.

On account of the interaction of the loop antenna 810 with the antenna 812 with magnet core 822, a magnetic field is produced or can be detected with sufficient sensitivity and hence a sufficiently large current can be induced that has sufficiently large magnetic field components in all three spatial directions. The magnetic field lines of the magnetic field that can be generated or processed by means of the antenna structure 808 are denoted by reference symbol 830 in FIG. 8A and FIG. 8B.

In various embodiments, the second side 806 of the support 802 may optionally be provided with a contact array 832 having one or more contact pads 834 (for example made of a metal or a metal alloy, for example made of Au). The contact array 832 may be designed on the basis of the ISO 7816 standard.

Alternatively or in addition, however, the contact array 832 may also be arranged on the first side of the support 802 (and hence on the same side as the antenna). In this way, provision may be made for the antenna arrangement also to be arranged on the same side as the contact array. The antennas could also be incorporated into a printed circuit board (PCB) (e.g. a PCB layer could contain ferrite material).

Hence, in various embodiments, the antenna arrangement may be in the form of a contactless antenna arrangement (for example in the form of a contactless chip card) and optionally additionally in the form of a contact-including antenna arrangement (for example in the form of a contact-including chip card).

In various embodiments, the loop antenna 810 and/or the antenna 812 with magnet core 822 and hence the antenna structure 808 may be power-matched for a carrier frequency situated in a range of approximately 13.56 MHz or of approximately 433 MHz or of approximately 868 MHz or of approximately 2.4 GHz or another frequency. As a good example, power/impedance matching may be provided at a prescribable operating frequency.

In various embodiments, the loop antenna and the magnet core antenna may not be directly electrically connected to one another and can be powered separately by different sources or by the same source, to which the antennas are power-matched separately for a particular operating frequency. Furthermore, the antennas can be supplied with currents of different amplitudes and/or different phases so as to achieve a particular structure for the magnetic field—that results from the superimposition of the individual magnetic fields from both antennas.

Figure 9:
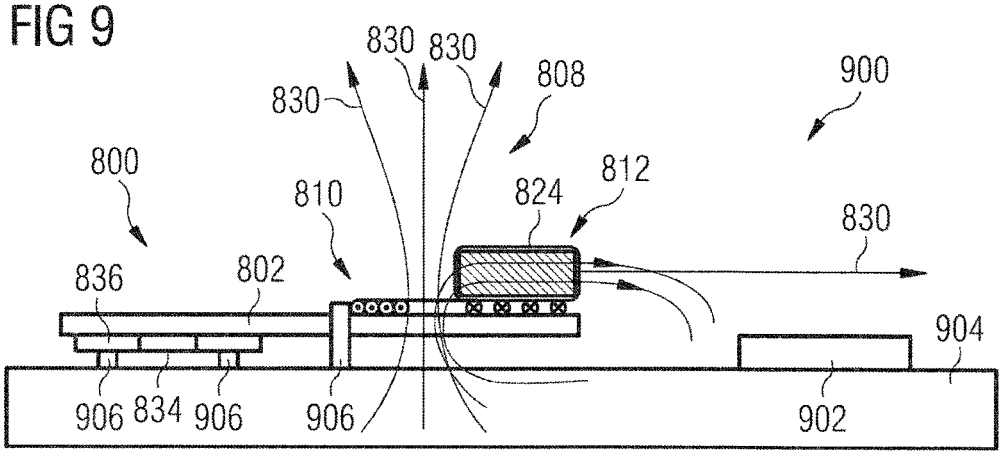
FIG. 9 shows a cross-sectional view of an antenna arrangement according to various embodiments.
Figure 10:
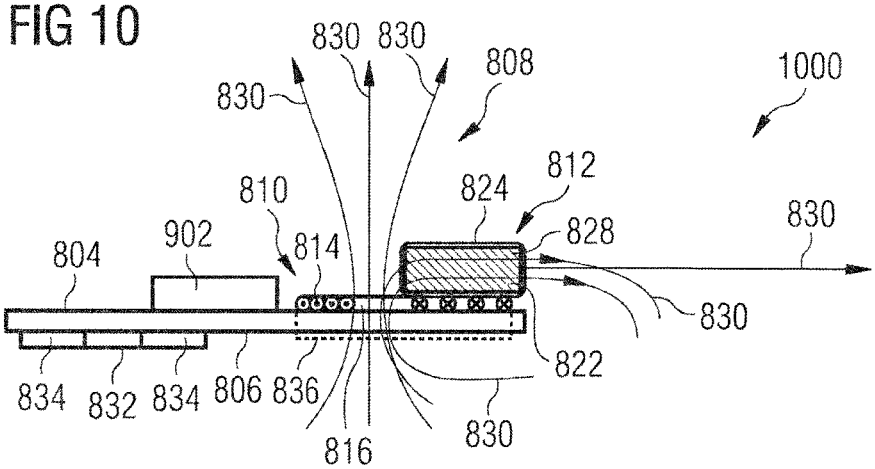
FIG. 10 shows a cross-sectional view of an antenna arrangement according to various embodiments.

FIG. 9 shows a cross-sectional view of an antenna arrangement 900 according to various embodiments. In addition to the portion 800 of the antenna arrangement 900, as has been described above, the antenna arrangement 900 has at least one integrated circuit (for example a chip) 902. The integrated circuit 902 may be provided on the support 802 itself (see antenna arrangement 1000 in FIG. 10), or alternatively on a printed circuit board 904, with the antenna structure 808 and possibly the one or more contact pads 834 being electrically conductively connected by means of electrically conductive connections 906 (for example solder joints 906) to electrical contacts of the printed circuit board 904 and, above the latter, to pads on the integrated circuit 902.

In various embodiments, the integrated circuit 902 may be an arbitrarily embodied circuit, for example an arbitrarily embodied logic chip, for example a hardwired logic chip, for example an application-specific integrated circuit (ASIC), or a programmable logic chip, for example a processor chip, for example a microprocessor chip. In addition, the logic chip may also have one or more memories, for example one or more volatile memories (for example a dynamic random access memory (DRAM)) or one or more nonvolatile memories (for example a read-only memory (ROM) or an erasable read-only memory (erasable programmable read-only memory EPROM), for example an electrically erasable read-only memory (electrically erasable programmable read-only memory EEPROM)). In other embodiments, other memory types may likewise be provided, such as resistive memories, such as magnetoresistive memories.

Figure 11:
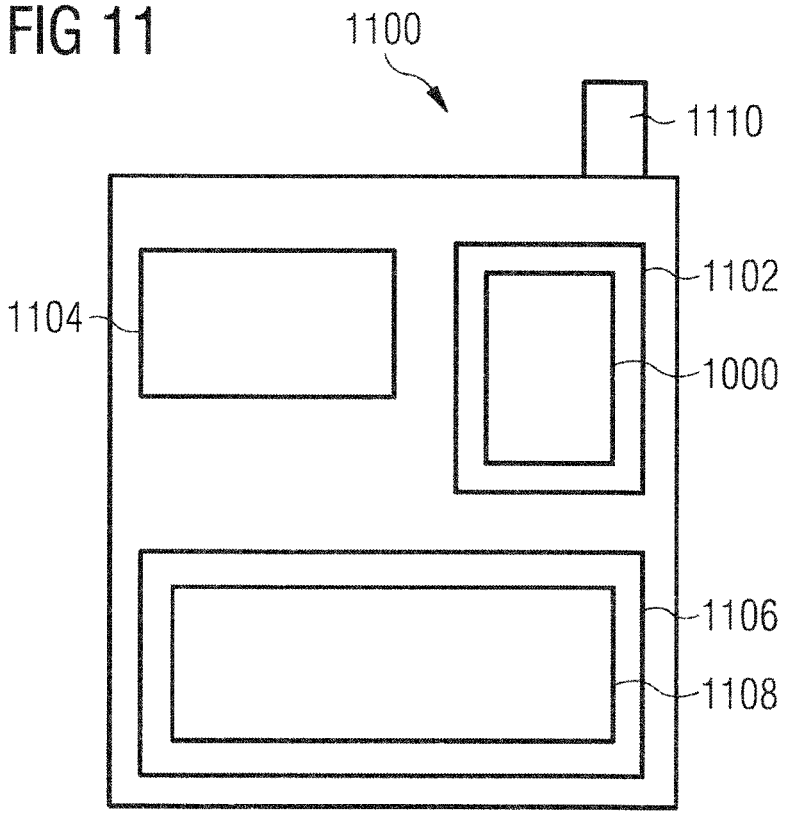
FIG. 11 shows a communication appliance with an antenna arrangement according to various embodiments.

FIG. 11 shows a communication appliance 1100 with an antenna arrangement 1000 according to various embodiments.

In various embodiments, the communication appliance 1100 may be provided as a communication terminal 1100 that is set up both for mobile radio remote communication and for near-field communication with a reader, as has been described above.

The communication appliance 1100 has an antenna arrangement holding region 1102 that may hold the antenna arrangement (for example antenna arrangement 1000). The antenna arrangement holding region 1102 may be in the form of a (U) SIM card holding region 1102, for example.

In addition, the communication appliance 1100 may have a communication circuit 1104 that is set up to provide radio communication. In other words, the communication circuit 1104 has the functionality for providing the desired protocol architectures in accordance with the respective communication standards supported by the communication appliance 1100 (for example within the context of near-field communication the ISO/IEC 14443 or ISO/IEC 18092 standard, and within the context of mobile radio remote communication GSM, UMTS, LTE, LTE-Advanced, or the like, for example).

In this connection, it should be noted that in various embodiments the antenna arrangement 1000 alone is sufficient to allow desired near-field communication; wherein the required protocol architectures are implemented in at least one integrated circuit that is connected to the antennas of the antenna arrangement and that is part of the latter; wherein the antenna arrangement is supplied with appropriate voltage by the communication appliance; wherein a contact-based, digital interface (for example SPI—serial parallel interface) is used between at least one integrated circuit that is part of the antenna arrangement and the communication appliance in order to execute an application stored on the communication appliance on the basis of data interchange by means of near-field communication.

In addition, provision may be made for the communication circuit 1104 to be used in conjunction with an optionally provided magnetic antenna for near-field communication too. In this case, the loop antenna or magnet core antenna is possibly not used for near-field communication, however. It should be pointed out that the antenna structure 808 may be provided for near-field communication, as has been described above. For mobile radio remote communication, the communication appliance 1100 may have an additional antenna 1110 that may be coupled, for example may be electrically conductively connected, to the communication circuit 1104.

In addition, the communication appliance 1100 may have a battery compartment 1106 (generally a battery holding region 1106) for holding a battery 1108, for example a storage battery 1108. The battery holding region 1106 may have one or more battery contacts (not shown) that may be electrically coupled to the antenna arrangement 1000 and/or to the communication circuit 1104.

Figure 12:
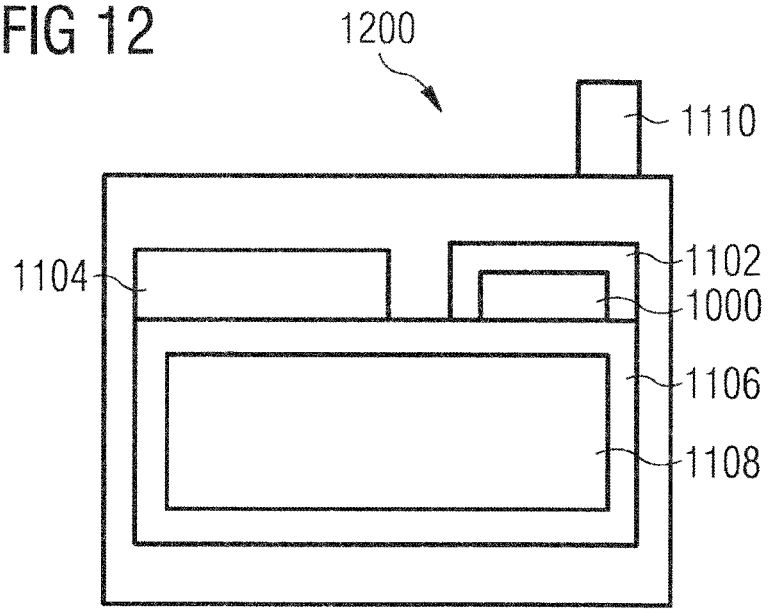
FIG. 12 shows a communication appliance with an antenna arrangement according to various embodiments.
Figure 13:
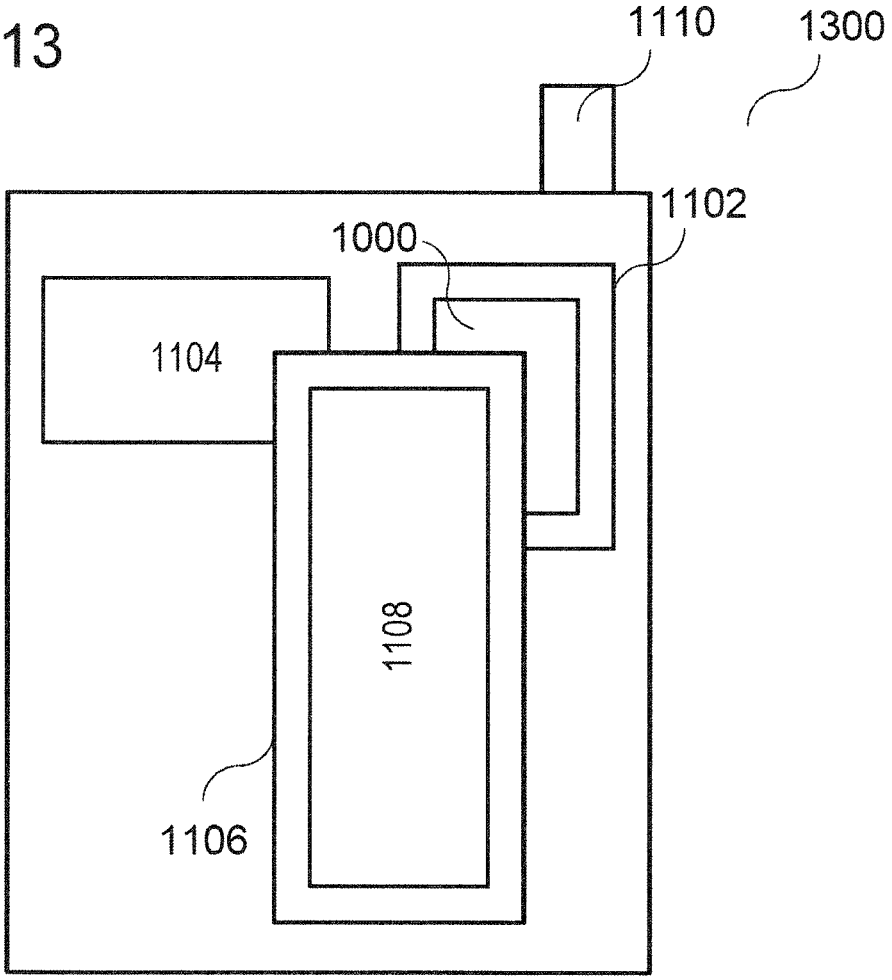
FIG. 13 shows a communication appliance with an antenna arrangement according to various embodiments.

As described above, the antenna structure 808 is—according to various embodiments—relatively insensitive in respect of the specific embodiment of the communication appliance 1100, for example in respect of the arrangement of metal elements in the communication appliance 1100, which act as a shield for magnetic field lines from a loop antenna, for example. Hence, in various embodiments of the communication appliance 1100, the battery holding region 1106 may be arranged next to or to some extent or completely above or below (see communication appliance 1200 in FIG. 12 or 1300 in FIG. 13) the antenna arrangement 1000 and hence the antenna structure 808, and nevertheless near-field communication by means of the antenna structure 808 continues to be possible.

Figure 14A:
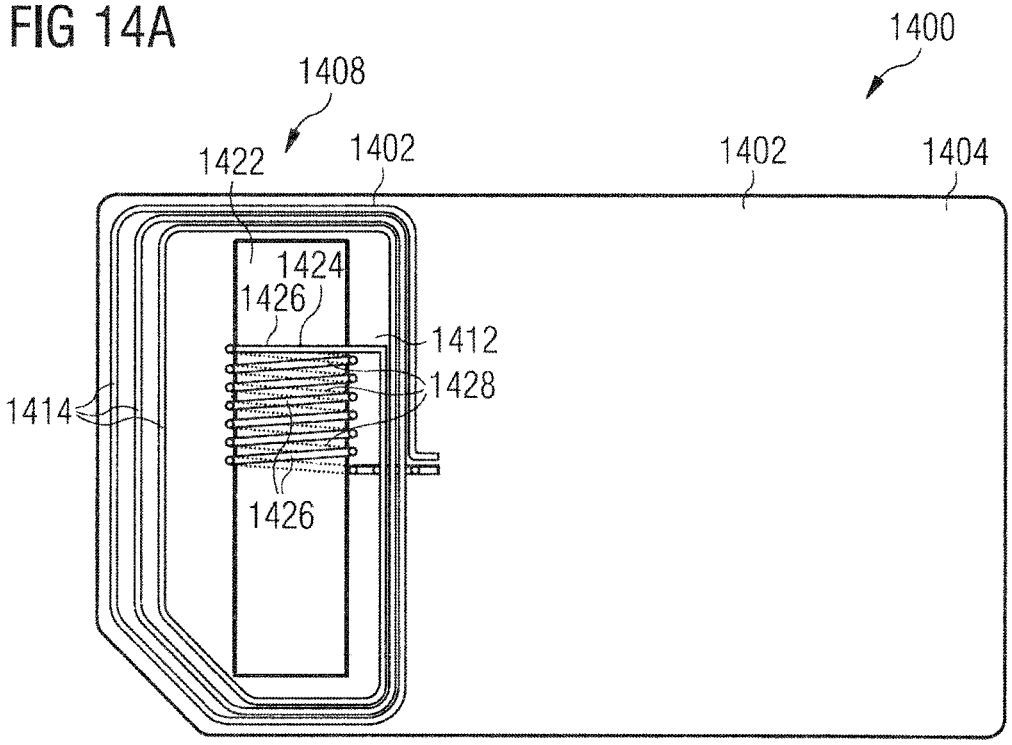
FIGS. 14A and 14B show a portion of an antenna arrangement in plan view (FIG. 14A) and in cross-sectional view (FIG. 14B) according to various embodiments.
Figure 14B:
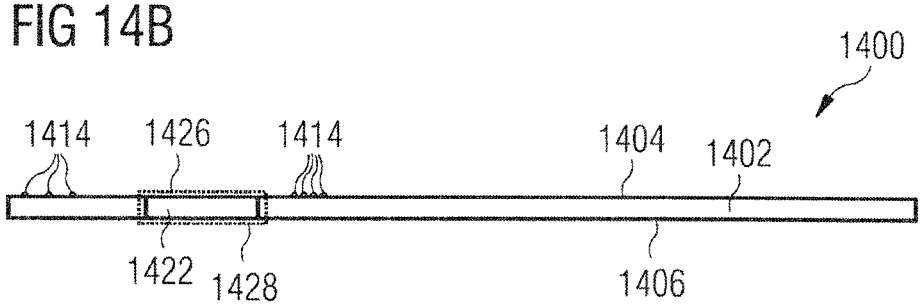

FIG. 14A and FIG. 14B show a portion of an antenna arrangement 1400 in plan view (FIG. 14A) and in cross-sectional view (FIG. 14B) according to various embodiments.

As FIG. 14A and FIG. 14B show, an antenna structure 1408 may be arranged on a support 1402, which has a first side 1404 (for example front 1404) and a second side (for example back 1406), which is opposite the first side. The antenna structure 1408 may have a loop antenna 1410 (having one or more turns 1414) and also an antenna 1412 having a magnet core 1422. The loop antenna 1410 may be arranged on the first side of the support 1402. In addition, the magnet core 1422 may be embedded in the support 1402, as shown in FIG. 14B. The turns 1424 that run around the magnet core 1422 therefore run to some extent on the first side of the support 1402 (this portion of the turns 1424 is provided with reference symbol 1426 in FIG. 14A and FIG. 14B) and to some extent on the second side of the support 1402 (this portion of the turns 1424 is provided with reference symbol 1428 in FIG. 14A and FIG. 14B).

FIG. 15A to FIG. 15D show various embodiments of a magnet core of a magnet core antenna.

Figure 15A:
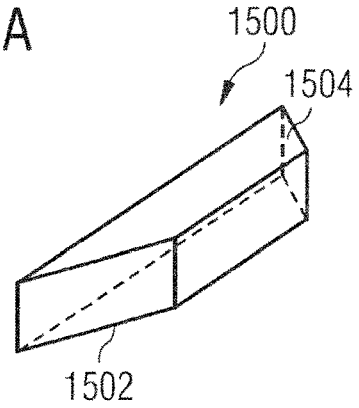
FIGS. 15A to 15D show various embodiments of a magnet core of a magnet core antenna.
Figure 15B:
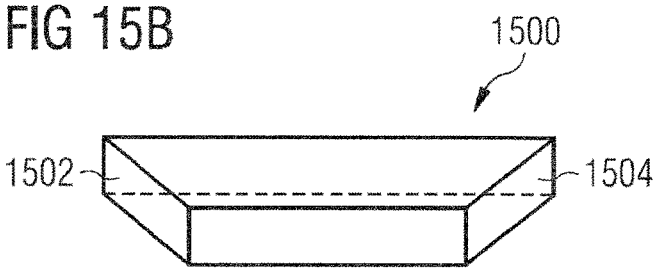
Figure 15C:
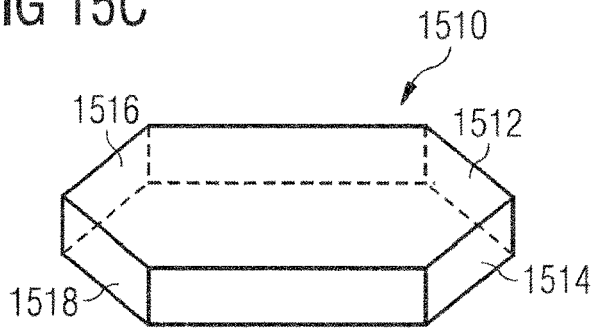
Figure 15D:
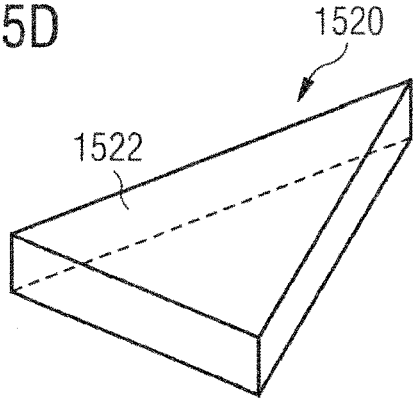

Thus, by way of example, FIG. 15A shows a magnet core 1500 with beveled end faces 1502, 1504 in a side view and FIG. 15B shows the magnet core 1500 with beveled end faces in a front view. In addition, FIG. 15C shows a magnet core 1510 with "tapered" end faces 1512, 1514, 1516, 1518. In addition, FIG. 15D shows a magnet core 1520 with a triangular base area 1522.

Figure 16A:
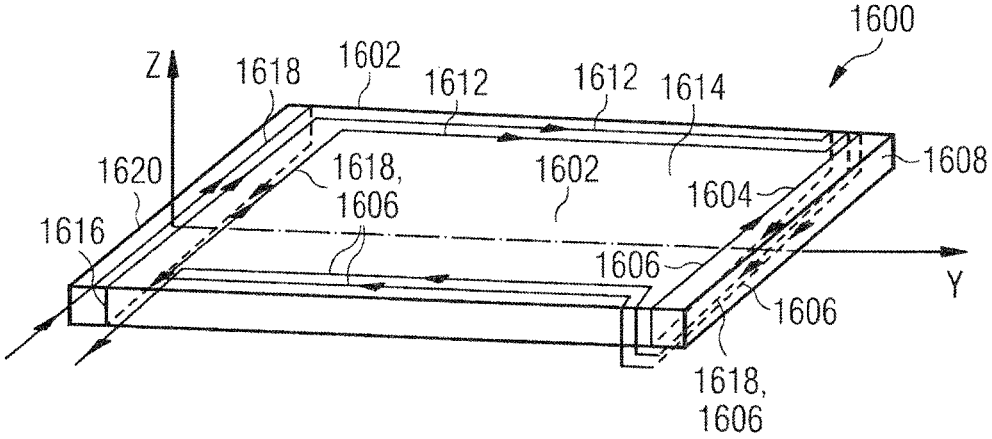
FIGS. 16A and 16B show an antenna structure according to various embodiments.
Figure 16B:
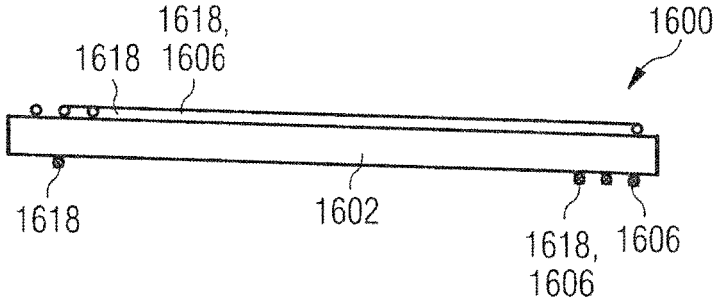

FIG. 16A and FIG. 16B show an antenna structure 1600 according to various embodiments in a plan view (FIG. 16A) and in a cross-sectional view (FIG. 16B).

As FIG. 16A shows, the antenna structure 1600 has at least one magnet body 1602, for example a ferrite body 1602.

Figure 17:
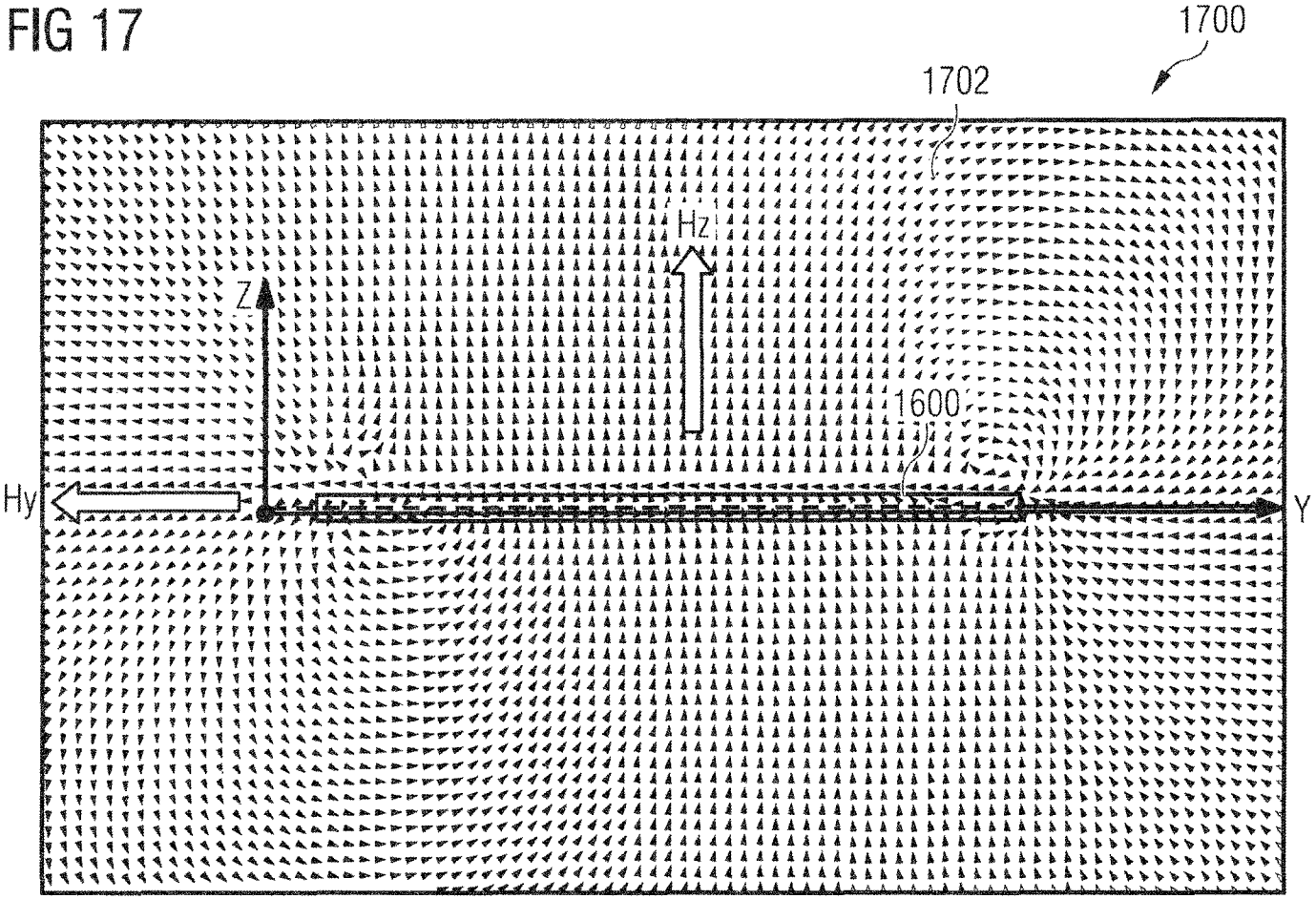
FIG. 17 shows an illustration of a magnetic field that is produced by the antenna structure shown in FIG. 16A and FIG. 16B.

By means of one or more electrically conductive structures, which is or are mounted or arranged to some extent on a surface of the magnet body 1602, for example a main surface of the magnet body 1602, such that a magnetic flux is provided by the main surface (for example a top face or a bottom face) and hence, as FIG. 17 shows, a magnetic field 1702 with a main orientation in the z direction (Hz) is provided. In addition, one or more electrically conductive structures is or are provided that is or are mounted or arranged, for example wound, around the magnet body 1602 such that a magnetic flux is provided by one or more lateral faces of the magnet body 1602 and hence, as FIG. 17 shows, the magnetic field 1702 is additionally provided with a main orientation in the y direction (Hy or Hx).

Hence, by way of example, the antenna structure 1600 also has at least one first antenna region 1604, which is formed by a first electrically conductive structure 1606 that runs around the magnet body 1602, as a result of which a first magnetic flux (Hy or Hx) is provided by a first surface 1608 of the magnet body 1602. In addition, at least one second antenna region 1610 may be provided that is formed by a second electrically conductive structure 1612 that runs on a second surface 1614 of the magnet body 1602 and forms a loop-like region 1610, so that a second magnetic flux (Hz) is provided by a second surface 1614 of the magnet body 1602. The second surface 1614 may be at an angle (for example of approximately 90°, but not limited thereto) to the first surface 1608. As a good example, the loop-like region 1610 forms a ferrite-based antenna.

In addition, the antenna structure 1600 may have at least one third antenna region 1616, which is formed by a third electrically conductive structure 1618 that runs around the magnet body 1602, so that a third magnetic flux (Hx or Hy) is provided by a third surface 1620 of the magnet body 1602. The first antenna region 1604 and the third antenna region 1616 may be arranged on opposite marginal regions of the magnet body 1602 (for example at a distance in a range from approximately 5 mm to approximately 20 mm, for example of approximately 10 mm from the edge of the magnet body 1602).

The first electrically conductive structure 1606 and the second electrically conductive structure 1612 (and possibly the third electrically conductive structure 1618) may be electrically conductively connected to one another and, as a good example, may therefore form a common electrically conductive structure.

As already explained above, the first electrically conductive structure 1606 may focal at least one turn around the magnet body 1602. In addition, the third electrically conductive structure 1618 may likewise form at least one turn around the magnet body 1602.

In addition, in various embodiments, an antenna arrangement has an antenna structure 1600, as shown in FIG. 16A and FIG. 16B. In addition, the antenna arrangement may have at least one integrated circuit, as has been described above in connection with the antenna arrangements of other embodiments, for example. The antenna structure 1600 may be coupled (for example electrically conductively) to the at least one integrated circuit.

Various embodiments provide an antenna arrangement, having: at least one integrated circuit (for example a chip); at least one loop antenna that is coupled to the integrated circuit (for example by means of a matching network) and that forms a loop antenna region; at least one antenna that is coupled to the integrated circuit and that has a magnet core (subsequently also referred to as a magnet core antenna); wherein at least one portion of the magnet core is arranged above a portion of the loop region; wherein the portion of the magnet core may overlap the portion of the loop antenna region; or wherein a portion of the magnet core may not overlap the portion of the loop antenna region.

The portion of the magnet core and the portion of the loop antenna region may be arranged relative to one another such that they influence one another in terms of the respective magnetic fields produced, which means that the respective magnetic fields produced have a desired structure.

The loop antenna region may be formed by the entire region of the loop antenna, i.e. as a good example by the region that contains a turn or the plurality of turns of the loop antenna, and also by the loop region that is situated inside the one or more turns.

The antenna structure may be formed by two antennas (a loop antenna and an antenna having a magnet core), wherein the at least one portion of the magnet core is arranged above a portion of the loop antenna region of the loop antenna (as a good example at least one portion of the magnet core covers a portion of the loop antenna region at the bottom or top), which makes the antenna structure considerably more robust in terms of the arrangement of metal components close to the antenna structure, and hence less sensitive to interference. According to various embodiments, this renders the antenna structure less sensitive in respect of the placement of, by way of example, an antenna arrangement (for example a SIM) provided with the antenna structure within a communication appliance, for example a mobile radio communication terminal.

In one embodiment, the antenna arrangement may also have a (common) support, wherein the loop antenna and the antenna are arranged on the support.

In another embodiment, the loop antenna may have at least one turn and may be in the form of a planar antenna.

In another embodiment, the antenna may have at least one turn that is arranged around the magnet core.

In another embodiment, the material of the magnet core may have a relative magnetic permeability index of greater than 1. In other words, the material of the magnet core can be formed from a magnetic conductor and hence routing of the magnetic field can be achieved.

In another embodiment, the material of the magnet core may be formed from a ferrite material (for example Ni—Zn—Cu) and hence have a relative magnetic permeability index of 150, for example.

In another embodiment, the magnet core may have a longitudinal extent, and the at least one turn may be arranged around the longitudinal faces of the magnet core.

In another embodiment, the magnet core may have a transverse extent, and the at least one turn may be arranged around the end faces of the magnet core.

The magnet core of the magnet core antenna may have a basically arbitrary shape, for example one of the following shapes: cylinder, parallelepiped/cylinder, for example with "tapered" end faces, or the like. Alternative forms may naturally likewise be provided in alternative embodiments.

In another embodiment, the antenna arrangement may also have at least one contact pad, wherein the contact pad is arranged on the support.

In another embodiment, the antenna arrangement may also have at least one circuit that is coupled to the loop antenna and/or to the antenna.

In another embodiment, the antenna may cover no more than 75% of the area of the loop antenna region, for example no more than 70% of the area of the loop antenna region, for example no more than 65% of the area of the loop antenna region, for example no more than 60% of the area of the loop antenna region, for example no more than 55% of the area of the loop antenna region, for example no more than 50% of the area of the loop antenna region, or less, but, by way of example, at least 10% of the area of the loop antenna region, for example at least 15% of the area of the loop antenna region, for example at least 20% of the area of the loop antenna region, for example at least 25% of the area of the loop antenna region, for example at least 30% of the area of the loop antenna region, for example at least 35% of the area of the loop antenna region.

In another embodiment, the antenna arrangement may be set up as a module that has a memory and/or a logic circuit, for example as a subscriber identity module. Alternatively, the module may be set up as one of the following modules, for example: microSD, microSIM, nanoSIM.

In another embodiment, the loop antenna and/or the antenna can be power-matched for a carrier frequency situated in a range of approximately 13.56 MHz or of approximately 433 MHz or approximately 868 MHz or of approximately 2.4 GHz or of approximately 125 kHz.

In various embodiments, a communication appliance, for example a communication terminal, is provided, having: an antenna arrangement, as has been described above or is yet to be explained in more detail below, and also a communication circuit, set up to provide radio communication.

In one embodiment, the communication appliance may also have a battery holding region for holding a battery; wherein the battery holding region has battery contacts for making electrical contact with battery connections on a battery arranged in the battery holding region; wherein the battery contacts are electrically coupled to the antenna arrangement and/or to the communication circuit.

In various embodiments, an antenna structure is also provided, having: at least one loop antenna that forms a loop antenna region; and at least one antenna having a magnet core; wherein at least one portion of the magnet core is arranged above a portion of the loop antenna region, the portions possibly overlapping or else not overlapping.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. An antenna arrangement, comprising:

at least one integrated circuit;

at least one first planar antenna contacting a support structure and coupled to the at least one integrated circuit and that forms a first planar antenna region; and wherein the support structure is configured to couple to a substrate;

at least one second antenna coupled to the integrated circuit having a magnet core; and wherein the magnet core comprises a magnetic axis parallel to an edge of the support structure; wherein at least one portion of the at least one second antenna is arranged over the first planar antenna region; and wherein the at least one integrated circuit is disposed on the support structure or the substrate.

2. The antenna arrangement of claim 1, further comprising:

a support;

wherein the at least one first planar antenna and the at least one second antenna are arranged on a front side of the support.

3. The antenna arrangement of claim 1, wherein the at least one first planar antenna has at least one turn and the first planar antenna is in the form of a planar loop antenna.

4. The antenna arrangement of claim 1, wherein the at least one second antenna has at least one turn that is arranged around the magnet core.

5. The antenna arrangement of claim 1, wherein the material of the magnet core has a relative magnetic permeability index of greater than 1.

6. The antenna arrangement of claim 5, wherein the material of the magnet core is formed from a ferrite material.

7. The antenna arrangement of claim 4, wherein the magnet core has a longitudinal extent;

wherein the at least one turn is arranged around the longitudinal lateral faces of the magnet core.

8. The antenna arrangement of claim 4, wherein the magnet core has a transverse extent;

wherein the at least one turn is arranged around the end faces of the magnet core.

9. The antenna arrangement of claim 2, at least one contact pad;

wherein the at least one contact pad is arranged on the back side of the support.

10. The antenna arrangement of claim 1, wherein the antenna with the magnet core covers no more than 75% of the area of the loop antenna region.

11. The antenna arrangement of claim 1, configured as a module that has at least one of at least one memory or a logic circuit.

12. The antenna arrangement of claim 1, wherein at least one of the first planar antenna or the second antenna is power-matched for a carrier frequency situated in a range of one of the following:

approximately 13.56 MHz;

approximately 433 MHz;

approximately 125 kHz;

approximately 868 MHz; and approximately 2.4 GHz.

13. A communication appliance, comprising:

an antenna arrangement, comprising:

at least one integrated circuit;

at least one first planar antenna that is coupled to the integrated circuit and that forms a first planar antenna region contacting a support structure; and wherein the support structure is configured to couple to a substrate; and wherein at least one integrated circuit is disposed on the support structure or the substrate;

at least one second antenna that is coupled to the integrated circuit and that has a magnet core;

wherein the magnet core comprises a magnetic axis parallel to an edge of the support structure; wherein at least one portion of the magnet core is arranged over the first planar antenna region; and a communication circuit, configured to provide radio communication.

14. The communication appliance of claim 13, further comprising:

a battery holding region for holding a battery;

wherein the battery holding region has battery contacts for making electrical contact with battery connections on a battery arranged in the battery holding region;

wherein the battery contacts are electrically coupled to at least one of the antenna arrangement or to the communication circuit.

15. An antenna structure, comprising:

at least one first planar antenna that forms a first planar antenna region contacting a support structure; and wherein the support structure is configured to couple to a substrate;

at least one second antenna having a magnet core; and wherein the magnet core comprises a magnetic axis parallel to an edge of the support structure; wherein at least one portion of the second antenna is arranged over the first planar antenna region; and wherein at least one integrated circuit is disposed on the support structure or the substrate.

16. An antenna structure, comprising:

at least one first planar antenna that forms a first planar antenna region; wherein the first planar antenna is a planar loop antenna;

at least one second antenna having a magnet body; wherein the magnet body comprises a magnetic axis parallel to an edge of the support structure; and wherein at least one portion of the second antenna is arranged over the first planar antenna region; and at least one third antenna region formed around the magnet body; and wherein the antenna arrangement is a subscriber identity module.

17. The antenna structure of claim 16, wherein the first planar antenna and the second antenna are electrically conductively connected to one another.

18. The antenna structure of claim 16, wherein the at least one second antenna comprises a first electrically conductive structure forms at least one turn around the magnet body.

19. The antenna structure of claim 16, wherein the second antenna region and the third antenna region are arranged on opposite marginal regions of the magnet body.

20. An antenna arrangement, comprising:

at least one integrated circuit;

at least one antenna structure that is coupled to the integrated circuit, the at least one antenna structure comprising:

at least one first planar antenna that forms a first planar antenna region;

wherein the first planar antenna is a planar loop antenna;

at least one second antenna having a magnet body; wherein the magnet body comprises a magnetic axis parallel to an edge of the support structure; and wherein at least one portion of the second antenna is arranged over the first planar antenna region; and at least one third antenna region formed around the magnet body.

* * * * *